United States Patent [19]

Blackwood et al.

[11] 4,325,684

[45] Apr. 20, 1982

[54] BRICK MOLDING MACHINE

[76] Inventors: Rodger Blackwood; John G. Medway, both of P.O. Box 1210, High River, Alberta, Canada

[21] Appl. No.: 11,128

[22] Filed: Feb. 12, 1979

[30] Foreign Application Priority Data

Oct. 31, 1978 [CA] Canada ..... 315610

[51] Int. Cl.[3] ..... B28B 13/00

[52] U.S. Cl. ..... 425/62; 425/125; 425/261

[58] Field of Search ..... 425/62, 125, 261, 451, 425/451.5; 249/18

[56] References Cited

U.S. PATENT DOCUMENTS 2,524,683 10/1950 Sumpf ..... 425/62

3,799,490 3/1974 Bunger ..... 249/18

*Primary Examiner*—John A. Parrish

*Attorney, Agent, or Firm*—William R. Hinds; George H. Dunsmuir

[57] ABSTRACT

A mobile brick molding machine includes a rectangular frame with a mold therein, the mold being a grid with open top and bottom ends for receiving a brick-forming composition when resting on the ground. The frame is provided with a wheel at its front center and a pair of wheels at the rear end thereof. The front wheel supports a jack, which is connected by a cable to a lever supporting one of the rear wheels whereby raising of the front end of the frame and mold using the jack results in virtually simultaneous upward movement of the rear end of the frame leaving the molded bricks.

2 Claims, 7 Drawing Figures

BRICK MOLDING MACHINE

BACKGROUND OF THE INVENTION

This invention relates to a brick molding machine and in particular to a mobile brick molding machine.

The machine disclosed herein is generally of the same type as that described in U.S. Pat. No. 2,524,683, which issued to H. C. Sumpf on Oct. 3, 1950. The Sumpf machine is somewhat complicated, including a wheel-supported main frame for movement along the ground, a secondary frame vertically adjustably suspended in the main frame, a multiple brick mold or form in the secondary frame and a hopper assembly movable along the secondary frame for filling the mold with brick mix. A complicated system of cables and pulleys, and a pneumatic or hydraulic cylinder are required for supporting, raising and lowering the secondary frame and mold.

The object of the present invention is to provide a relatively simple mobile brick molding machine, i.e. a machine which is both simply constructed and easy to operate.

BRIEF SUMMARY OF THE INVENTION

Accordingly, the present invention relates to a mobile brick molding machine comprising a frame; mold means mounted in said frame, said frame having an open bottom end; hopper means movably mounted on said frame means for filling said mold means with brick forming composition; first wheel means supporting one end of said frame, said first wheel means including jack means for raising and lowering said one end of said frame and a wheel connected to said jack means; second wheel means supporting the other end of said frame, said second wheel means including lever means for raising or lowering said other end of the frame and wheels connected to said lever means; and linkage means interconnecting said jack and lever means, whereby raising of said one end of said frame by said jack means results in simultaneous raising of said other end of said frame by said lever means to a mold emptying position.

BRIEF DESCRIPTION OF THE DRAWINGS

The invention will now be described in greater detail with reference to the accompanying drawings, which illustrate a preferred embodiment of the invention, and wherein.

Figure 1:
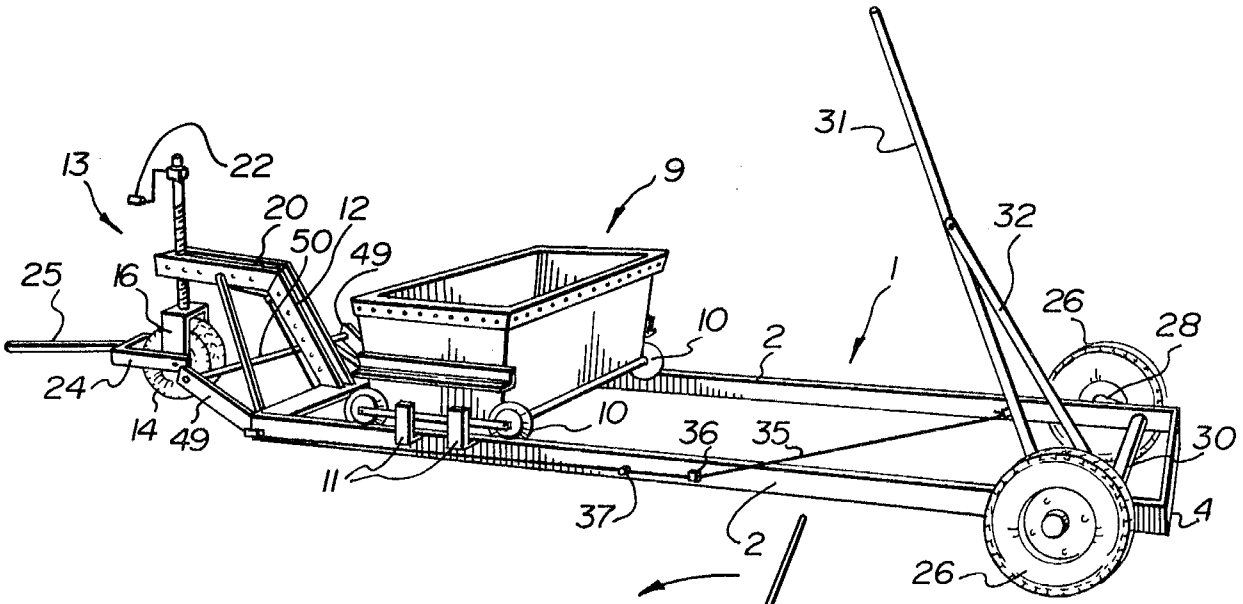
FIG. 1 is a perspective view from above and the rear of a brick molding machine in accordance with the present invention, with parts omitted.
Figures 3, 4, 5:
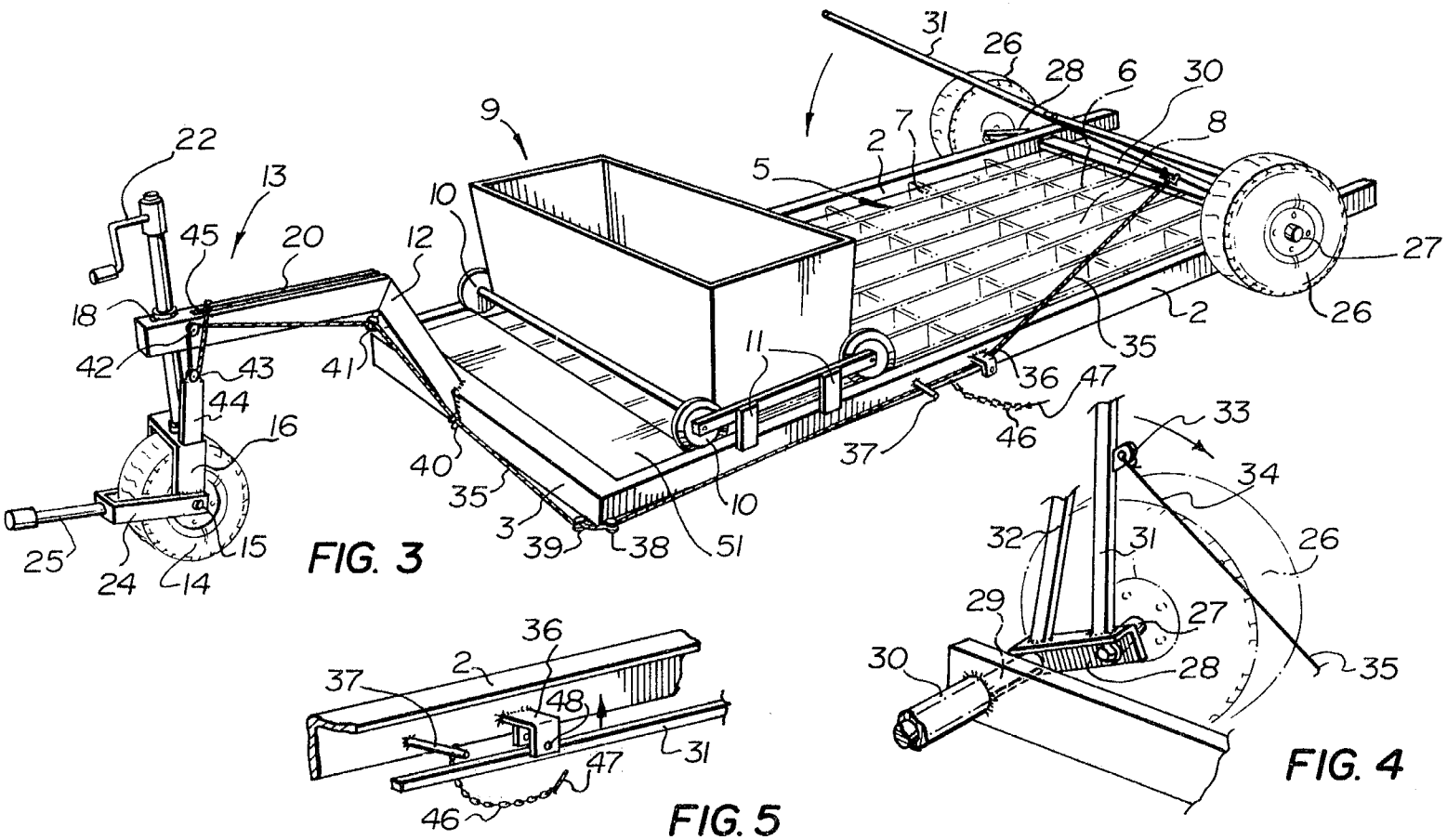

FIGS. *2a, 2b* and *2c* are elevational views of the molding machine of FIG. 1, with parts omitted, in molding, partially elevated and uppermost positions, in that order;

FIG. 3 is a perspective view from above and the front of the molding machine of FIGS. 1 to *2c;*

Figure 2A:
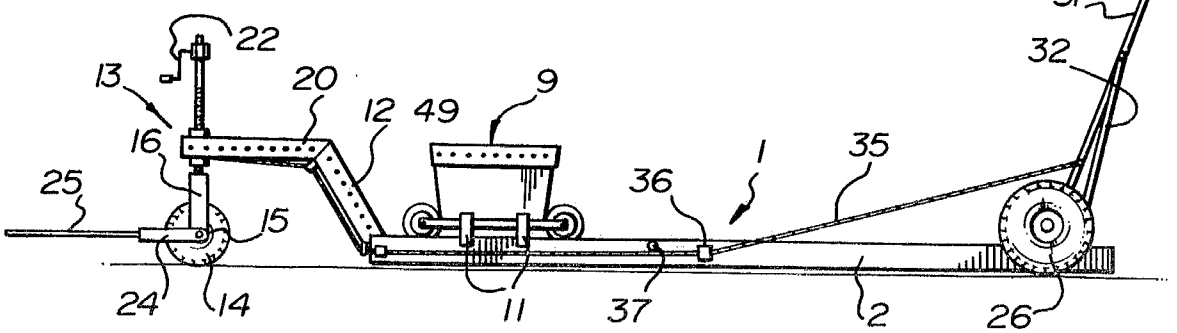

FIG. 4 is a perspective view of one rear wheel and lever means of the molding machine of FIGS. 1 to 3; and FIG. 5 is a perspective view of a portion of the linkage means of the molding machine of FIGS. 1 to 4.

DESCRIPTION OF THE PREFERRED EMBODIMENTS

With reference to the drawings, the brick molding machine of the present invention includes a rectangular frame generally indicated at 1 formed by sides 2, front end 3 and rear end 4. The frame 1 supports a mold generally indicated at 5 (FIG. 3). The mold 5 is merely a rectangular frame with a grid therein formed by longitudinally and transversely extending slats 6 and 7, respectively, defining a plurality of individual mold cavities 8 for bricks. The mold 5 is releasably mounted in the frame 1. The frame 1 also supports a hopper generally indicated at 9. The hopper 9 is a generally parallelepipedic container with an open lower end for dispensing brick forming composition into the mold cavities 8. The hopper 9 extends across the frame 1 and is movably mounted on the frame by flanged wheels 10. Arms 11 extend downwardly from the sides of the hopper 9 for maintaining the hopper 9 on the tracks defined by the sides of the frame 1. The hopper 9 can be moved longitudinally along the frame 1 either manually or by cables and a suitable drive (not shown).

A generally L-shaped arm 12 extends upwardly and forwardly from the centre of the front end 3 of the frame 1 to wheel means generally indicated at 13 for supporting the front end of the frame. The wheel means 13 includes a wheel 14 rotatably mounted on an axle 15 extending between the sides of an inverted U-shaped frame 16. A jack extends upwardly from the top of the frame 16, the jack including a screw shaft freely rotatably mounted on the frame 16 and passing through an internally threaded sleeve 18 in the outer end 20 of the arm 12. The shaft is turned by a handle 22 at the top end thereof for raising or lowering the front end of the frame 1. The arms of a U-shaped bracket 24 are pivotally mounted on the axle 15, with a tow bar 25 extending forwardly therefrom for connecting the machine to a towing vehicle (not shown).

The rear end of the frame 1 is supported by a pair of wheels 26. The wheels 26 are mounted on stub axles 27 (FIGS. 3 and 4), which project outwardly from one end of a short strip 28 of angle iron. The other end of the strip 28 is mounted on the outer end of a shaft 29 rotatably mounted in a sleeve 30 extending between and welded to the inner surfaces of the sides 2 of the frame 1. One strip 28 forms part of a lever, which includes a pair of arms 31 and 32, connected to the strip 28 adjacent each end thereof. The arm 32 is inclined toward the arm 31, and its outer end is connected to the middle of the arm 31. A lug 33 is provided on the front edge of the arm 31 near the bottom end thereof. One end 34 of a wire cable 35 is connected to the lug 33. An inverted U-shaped bracket 36 is provided on one side 2 of the frame 1 for retaining the arm 31 when the arm is in the towing position (FIG. *2C*), i.e. for moving the machine from one position to another. The cable 35 passes beneath and is guided by a pin 37 extending outwardly from one side 2 of the frame 1 and around pulleys 38, 39, 40, 41, 42 and 43 to the outer end 20 of the arm 12 on the front end of the frame 1. For the sake of simplicity, the cable and pulley system is shown completely in FIG. 3, but incompletely in FIGS. 1, *2a, 2b,* and *2c.* The pulley 43 is rotatably mounted on an arm 44 extending upwardly from the frame 16. The front end of the cable 35 is securely connected to the arm 12 at 45.

A chain 46 is attached to the side 2 of the frame 1 between the bracket 36 and the pin 37. A pin 47 on the other end of the chain 46 can be inserted into aligned apertures 48 in the arms of the bracket 36 for holding the lever arm 31 in the towing position (FIGS. *2c* and 5). In use the arm 31 is manually depressed from the position shown in FIG. *2b* to the towing position (FIG.

2c) in which the arm 31 is hooked under the bracket 36 and pinned with pin 47 for towing.

A pair of arms 49 (FIG. 1) extend outwardly and upwardly from the front end of the frame 1, with a rod 50 extending between the outer free ends thereof. The rod 50 supports a roll (not shown) of polyethylene sheeting, which prior to each molding operation is unrolled to provide a base for the mold 5 and for holding the bricks after the frame 1 and the mold 5 are raised.

It will be appreciated that the mold 5 and the frame 1 both have open top and bottom ends. Several different molds for a variety of brick shapes can be mounted in the frame 1. The mold surfaces can be treated with a release agent and/or the mold can be formed of a suitable plastic with non-stick properties.

Concerning the hopper 9, with some brick-forming compositions, vibrating during pouring may be necessary. Any form of mechanical and/or electrical vibration can be applied to the hopper. It is also possible to provide a plurality of bumps (grooves and/or projections) along the length of the tracks to cause the hopper to vibrate. The hopper 9 may also be provided with a mechanically actuated metering orifice in the bottom end thereof.

OPERATION

Figure 2B:
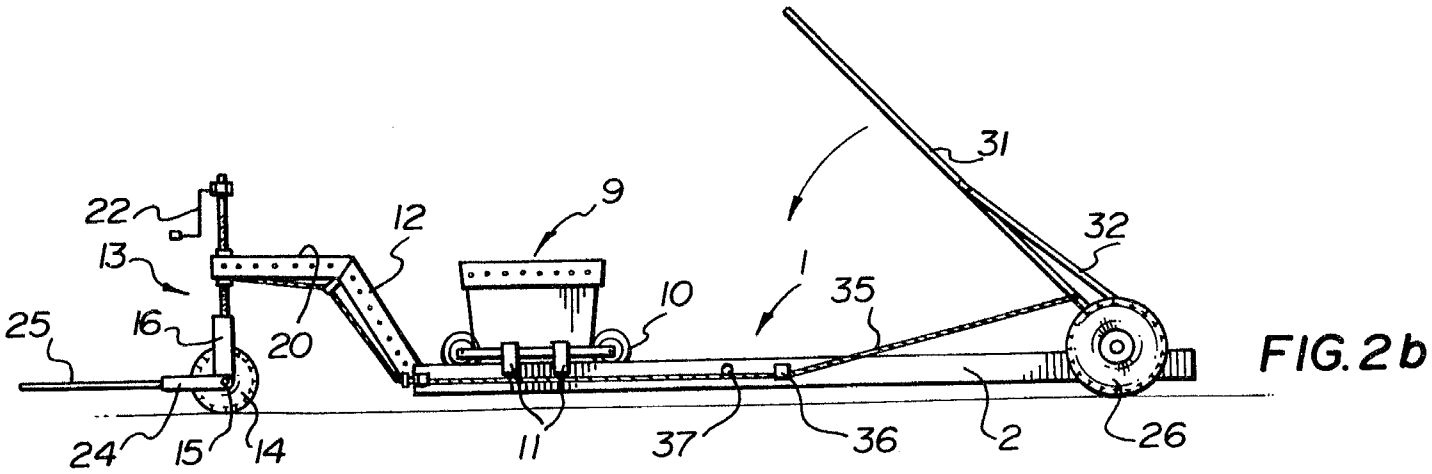
Figure 2C:
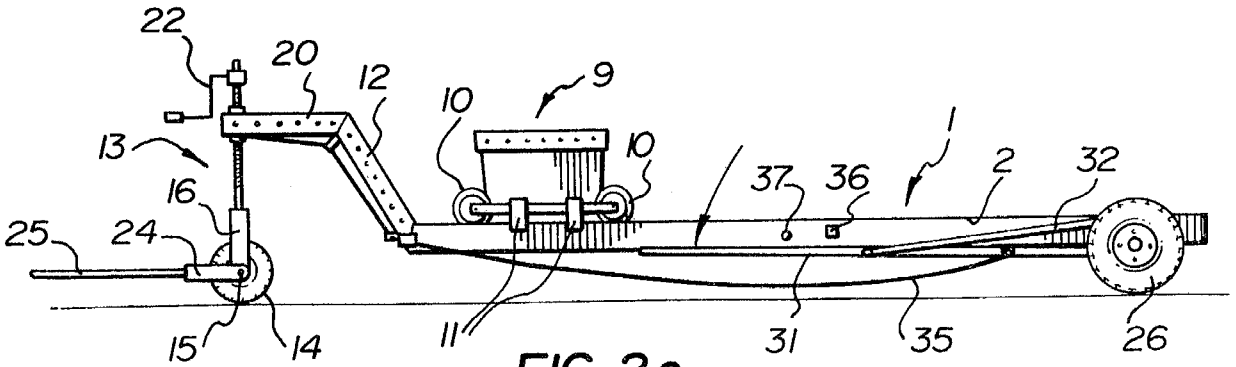

In the molding position, the frame 1 of the molding machine rests on the floor (FIG. 2*a*), with the lever arm 31 extending upwardly and rearwardly. With the frame 1 in the molding position and a length of polyethylene sheeting beneath the mold 5, the door or gate (not shown) of the hopper 9 is opened and the hopper is moved along the frame 1 to fill the mold cavities 8 with brick-forming composition. The gate of the hopper 9 in this embodiment of the invention is a plate 51 at the front end of the frame 1. The plate 51 extends between the sides of the frame 1 and closes the opening at the bottom end of the hopper 9 until the start of a molding operation when the hopper is moved away from the plate 51. As soon as the bricks have hardened sufficiently to maintain their shape, the frame 1 is raised to the brick depositing position to release the bricks, which are left beneath the frame on the polyethylene sheet. In order to raise the frame 1, the jack handle 22 is turned to cause the front end of the frame to move upwardly. As soon as the front end of the frame 1 starts to move upwardly, the cable 35 is placed under tension to pull the lever arm forward (FIGS. 1 and 2*b*). As the arm 31 moves forwardly and downward, the shaft 29 and consequently the rear end of the frame 1 are elevated. Thus, raising of the front end of the frame 1 by the jack results in simultaneous upward movement of the rear end of the frame ensuring the release of the molded bricks without damage. During upward movement of the frame, i.e. when the cable 25 is under tension, the cable is guided by the pin 37. When the frame 1 reaches its uppermost position (FIG. 2*c*), the lever arm 31 is secured in position above the floor by the chain 46 passing around the arm 31 with the pin 47 in the aligned apertures 48 of the bracket 36. The frame 1 with the mold 5 is normally moved to another molding station with the frame 1 in the position shown in FIG. 2*b*, leaving the molded bricks on the polyethylene sheet. At the second molding station another length of polyethylene sheeting is unrolled and placed beneath the mold 5, the sheeting is cut from the roll, and the frame 1 is lowered by raising the lever arm 31 and actuating the jack. The frame position illustrated in FIG. 2*c* is the towing position, i.e. the position of the frame during movement over long distances such as from one job site to another.

There has thus been described a simple mobile brick molding machine with relatively few moving parts. It will be appreciated that many variations may be employed such as, for example a different form of jack at the front end of the frame. Another form of jack could include a pair of telescoping sleeves, the bottom end of the outer sleeve being connected to the frame and the bottom end of the inner sleeve being connected to the U-shaped frame around the front wheel. A nut is fixed in the inner sleeve, and the top of a long bolt passing through the nut is secured in the top of the outer sleeve. The top of the bolt is a bevelled gear engaged by a second bevelled gear at a right angle thereto on the inner end of the handle. Thus, rotation of the handle would result in movement of the bolt in the nut and thus relative movement of the sleeves and thus of the frame and front wheel.

Further modifications and alternative embodiments of the invention will be apparent to those skilled in the art in view of the foregoing description. Accordingly, this description is to be construed as illustrative only and is for the purpose of teaching those skilled in the art the manner of carrying out the invention. It is further understood that the form of the invention herewith shown and described is to be taken as the presently preferred embodiment. Various changes may be made in the shape, size and general arrangement of components. For example, equivalent elements may be substituted for those illustrated and described herein, parts may be used independently of the use of other features, all as will be apparent to one skilled in the art after having the benefits of the description of the invention.

What is claimed is:

1. A mobile brick molding machine comprising a frame having an open bottom end;

mold means mounted in said frame for vertical movement therewith;

hopper means movably mounted on said frame means for filling said mold means with brick forming composition;

first wheel means for directly supporting one end of said frame for vertical movement with respect thereto, said first wheel means including jack means for raising and lowering said one end of said frame, and a ground engaging supporting wheel connected to said jack means;

second wheel means for directly supporting the other end of said frame for vertical movement with respect thereto, said second wheel means including lever means for raising and lowering said other end of the frame, ground engaging supporting wheels rotatably mounted on said lever means, and linkage means interconnecting said jack means and said lever means for operating said lever means such that raising said one end of said frame by said jack means results in simultaneous movement of said lever means and its wheels and raising of said other end of said frame by said lever means thereby moving said frame and said mold means from a first lower molding position to a second upper mold releasing position.

2. A molding machine according to claim 1, wherein said first wheel means includes a first wheel connected to the centre of the front end of said frame, and a jack above said wheel; said second wheel means includes a second wheel on each side of the rear end of said frame, and a lever rotatably supporting each said second wheel; and said linkage means is a cable interconnecting the front end of the frame and one lever, whereby upward movement of the front end of the frame actuates the levers to cause simultaneous upward movement of the rear end of the frame.

* * * * *